US005413094A

United States Patent [19]

McBrearty

[11] Patent Number: 5,413,094

[45] Date of Patent: May 9, 1995

[54] APPARATUS FOR REDUCING THE NOISE OF COUGHS AND SNEEZES

[76] Inventor: Edward McBrearty, 395 Ranch Rd., Indian River, Mich. 49749

[21] Appl. No.: 59,100

[22] Filed: May 10, 1993

[51] Int. Cl.[6] ..... G10K 11/12

[52] U.S. Cl. ..... 128/200.24; 181/242; 181/258

[58] Field of Search ..... 128/200.24; 181/18, 181/19, 20, 21, 22, 242, 258, DIG. 1; 381/158, 169, 157

[56] References Cited

U.S. PATENT DOCUMENTS

| | | | |
|---|---|---|---|
| 1,776,584 | 9/1930 | Gerlach | 181/242 |
| 2,508,581 | 5/1950 | Morrow | 381/158 |
| 2,572,547 | 10/1951 | Webb | 181/242 |
| 2,769,040 | 10/1956 | Di Mattia | 381/158 |
| 2,798,122 | 7/1957 | Ungarsohn | 181/198 |
| 3,244,816 | 4/1966 | Karns | 434/156 |
| 4,396,089 | 8/1983 | Scully | 181/242 |
| 4,932,495 | 6/1990 | Chapman | 181/242 |

OTHER PUBLICATIONS

*The Condensed Chemical Dictionary,* 10th ed., G. Hawey editor, Van Nostrand Reinhold Co., 1981, p. 891.

*Primary Examiner*—Edgar S. Burr
*Assistant Examiner*—Eric P. Raciti
*Attorney, Agent, or Firm*—Gifford, Groh, Sprinkle, Patmore and Anderson

[57] ABSTRACT

An apparatus for reducing the noise of coughs and sneezes by placement over the nose and mouth of the user. The apparatus has a core with a recessed portion to fit over the mouth and nose of the user and the core is made of a noise reducing material. A cover surrounds the core and has a section of absorbent material positioned over the recessed portion of the core. The noise reducing material of the core is a foamed resin. Vent holes are provided on the cover to allow the air forced into the core to exit the core and for the removal of moisture. A strap is attached to the cover to allow the user to wear the apparatus about the user's person until upon need, the apparatus is placed over the mouth and nose to reduce the noise of a cough or sneeze.

10 Claims, 1 Drawing Sheet

APPARATUS FOR REDUCING THE NOISE OF COUGHS AND SNEEZES

BACKGROUND OF THE INVENTION

I. Field of the Invention

The present invention relates to an apparatus for reducing the noise of coughs and sneezes. More particularly, the present invention relates to an apparatus held to the face of a user to cover the nose and mouth during a cough or sneeze in order to reduce the noise of the cough or sneeze.

II. Description of the Relevant Art

For many recreational pursuits quiet is essential. Hunting, bird watching and attending symphonic orchestra concerts are all dependent upon the noiselessness of the hunter, bird watcher or audience members. An undesirable result occurs when an individual coughs just as a potential quarry is nearby while hunting or during a particularly soft portion of a musical performance. It is therefore desirable from a hunter's or bird watcher's viewpoint and from other symphony patrons' viewpoints to limit the noise from coughs or sneezes. During attendance at symphonic orchestra concerts it has been known to use throat lozenges to lessen the need for coughing. Even the unwrapping of a throat lozenge can cause unwanted noise from the rustling of the cellophane wrapper which can alert the quarry during the hunt or can annoy the nearby audience members It often seems that if an attempt is made to stifle the cough or sneeze, it just becomes louder when it inevitably erupts.

Face masks have been known to be worn about the nose and mouth of a user. One such face mask is shown in U.S. Design Pat. No. 326,541 to McBrearty, Jr. This mask is worn by the user by attaching the ends at the back of the head.

Other type masks such as protective breathing masks are shown in U.S. Pat. No. 4,883,052 to Weiss et al and in U.S. Pat. No. 4,802,473 to Hubbard et al. These type masks are fairly thin layers using filtering material to impede transference from one side of the mask to the other.

U.S. Pat. No 4,834,212 to Figone et al discloses a sound muffler for covering the mouth while the user intentionally screams. Figone et al includes a microphone for receiving unabsorbed sound and measuring it However, the Figone et al patent suffers from the disadvantage that it is not convenient to transport for use as occasionally required and further it requires some kind of electrical power to operate.

Thus, none of the known methods of covering the mouth and face provide a useful and convenient cough and sneeze reduction device.

SUMMARY OF THE PRESENT INVENTION

The present invention relates to an apparatus for reducing sound from the mouth and nose of a user. The apparatus includes a core having a recessed portion for comfortable fit of the core and the apparatus to the face and over the mouth and nose of user. The core itself is of a noise reducing material.

A cover surrounds the core and has a section of absorbent material such as looped pile or terrycloth that is arranged over the recessed portion. The covering material can be of nylon in a camouflage pattern that appropriately matches the environment in which a hunter is using the device. The cover has sections assembled to fit the shape of the core. Of course, different materials can be used for the cover. Depending upon the selection of materials for the apparatus it may be washable.

Attached to the cover is a strap to allow the apparatus to be conveniently worn about the person and easily accessible for quick placement to cover the nose and mouth at the approach of a cough or a sneeze. Vent holes are provided on the cover to allow the air forced into the core from the cough or sneeze and the resulting accumulated moisture in the core to escape to the atmosphere. Grommets can be used on the vent holes to prevent the material from tearing around the holes.

The noise reducing material of the core is made of foam such as the kind commonly found in foam mattresses or cushions. The foam can be compressible to allow the apparatus to be easily stored in a pocket or other carrying device between the need for its use. The apparatus therefore can be stored until it is needed to be worn. The soft material used in the apparatus allows it to easily be stored and transported because it has no hard edges or excessive weight which may be objectionable to the user. The apparatus is preferably worn around the neck of the user and moved to the face and is placed firmly over the nose and mouth of the user as is necessary upon the approach of a cough or sneeze to reduce the resulting noise Accordingly, the apparatus for reducing the noise of cough and sneezes of the present invention overcomes the known problems of other types of face masks to reduce sound.

Other advantages and features of the present invention will become more apparent from the following detailed description when read in conjunction with the accompanying drawings.

BRIEF DESCRIPTION OF THE DRAWING

The present invention will be more fully understood by reference to the following detailed description, when read in conjunction with accompanying drawing wherein like reference characters refer to like parts and in which.

DETAILED DESCRIPTION OF THE INVENTION AND PREFERRED EMBODIMENT THEREOF

Figure 1:
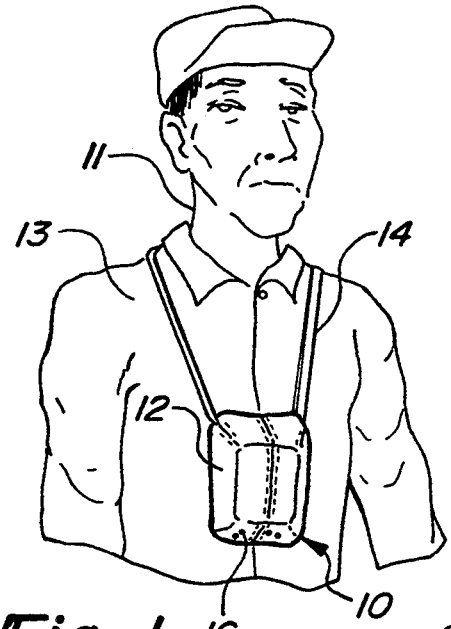
FIG. 1 is an environmental view of the apparatus for reducing the noise of coughs and sneezes being worn by the user.
Figure 2:
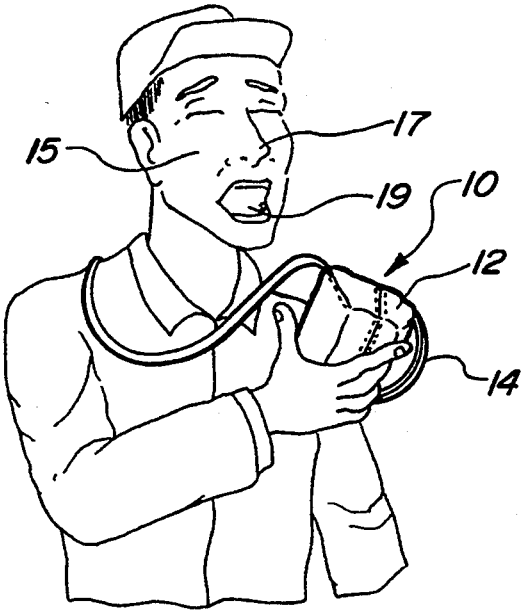
FIG. 2 is an environmental view of the apparatus being moved by the user into position to reduce the noise of a cough or a sneeze.
Figure 3:
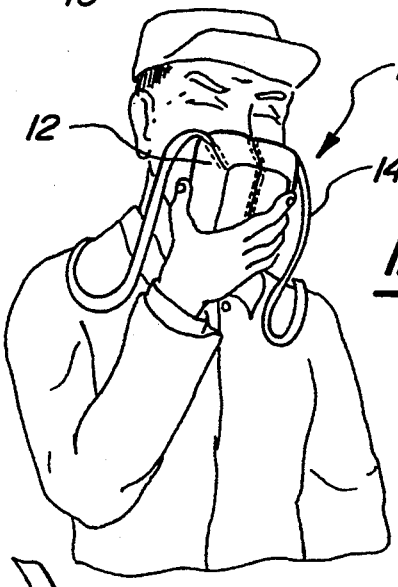
FIG. 3 is an environmental view of the apparatus in position as used to reduce the noise of a cough or sneeze with the apparatus held over the mouth and nose of a user.

The drawing discloses a preferred embodiment of the present invention. Referring to FIGS. 1, 2 and 3 the apparatus 10 for reducing the noise of coughs and sneezes of this invention is shown as including a cover 12 and a strap 14 attached to the cover 12. The cover 12 can be made of material having a camouflage pattern 13*a*. The apparatus 10 generally hangs around the neck 11 of the user 13 until it is needed at which time it is moved to the face 15 and placed over the nose 17 and mouth 19 of the user. Vent holes 16 are provided in the cover 12. Grommets 18 can be placed to reinforce the vent holes 16 as seen in FIG. 5.

Figure 4:
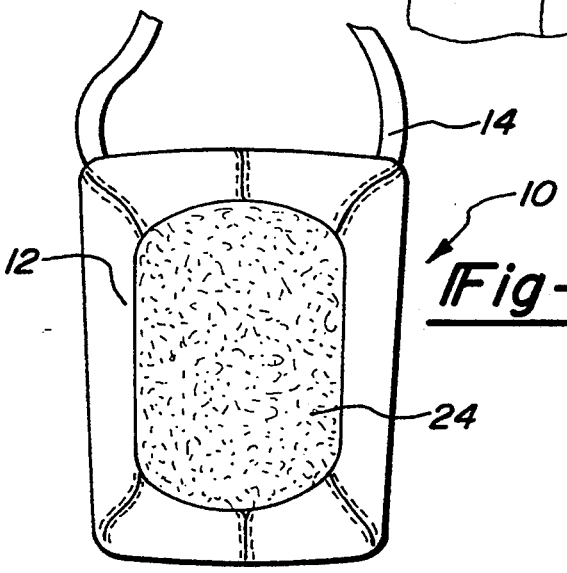
FIG. 4 is a front view of the apparatus showing the cover, the absorbent material and the strap attached to the cover.
Figure 5:
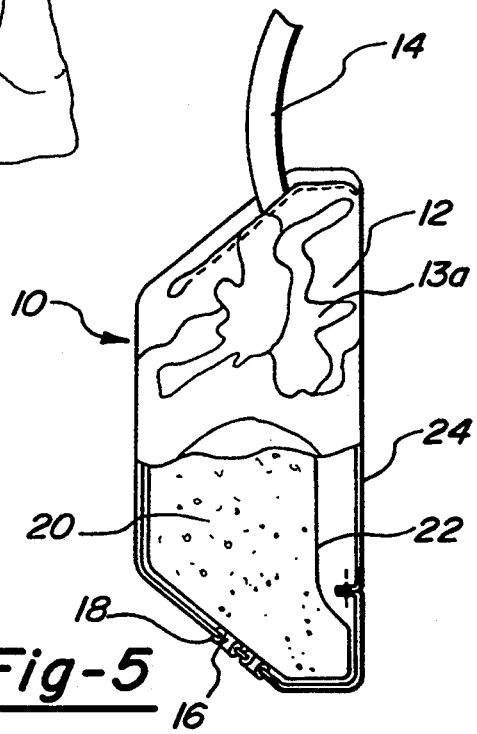
FIG. 5 is a side view of the apparatus partly in section showing the foam core, the recessed portion of the core, the cover with a camouflage pattern material and the vent holes in the cover.

Referring to FIGS. 4 and 5, the core 20 of the apparatus 10 is of foam. The 20 has a generally hexahedral shape with a recessed port absorbent material 24 forms a portion of the cover 12. Since the strap 14 is attached to the cover 12, the apparatus 10 can be worn for ready accessibility for use The recessed portion 22 has an oval shape which allows the core 20 to fit to the face of the user.

Having described my invention, many modifications thereto will become apparent to those skilled in the art to which it pertains without deviation from the spirit of the invention as defined by the scope of the appended claims.

I claim:

1. An apparatus for reducing the noise of coughs and sneezes comprising:

a core, said core being made of a noise-reducing material and having an outer perimeter which surrounds the nose and mouth of a user and a center, said center being recessed from said outer perimeter;

a cover surrounding said core wherein at least one surface of said cover is made of a moisture-absorbent material.

2. The apparatus for reducing the noise of coughs and sneezes according to claim 1 wherein said core is comprised of foam resin.

3. The apparatus for reducing the noise of coughs and sneezes according to claim 1 wherein said core has a hexahedral shape.

4. An apparatus for reducing the noise of coughs and sneezes according to claim 1 wherein said recessed center has an oval shape.

5. The apparatus for reducing the noise of coughs and sneezes according to claim 1 further comprising vent holes on said cover.

6. The apparatus for reducing the noise of coughs and sneezes according to claim 5 further comprising grommets around said vent holes on said cover.

7. The apparatus for reducing the noise of coughs and sneezes according to claim 1 further comprising a strap attached to said cover.

8. The apparatus for reducing the noise of coughs and sneezes according to claim 7 wherein said strap has a first end and a second end and said first end is attached to said cover and said second end is attached to said cover whereby a user can wear said apparatus.

9. The apparatus for reducing the noise of coughs and sneezes according to claim 1 wherein said moisture-absorbent material is of pile formed of loops.

10. The apparatus for reducing the noise of coughs and sneezes according to claim 9 wherein said looped pile moisture-absorbent material is terrycloth.

* * * * *